United States Patent [19]

Doi

[11] 4,050,274

[45] Sept. 27, 1977

[54] APPARATUS FOR FORMING GROOVED WHEELS

[75] Inventor: Yoshio Doi, Kariya, Japan

[73] Assignee: Toyoda Koki Kabushiki Kaisha, Japan

[21] Appl. No.: 676,519

[22] Filed: Apr. 13, 1976

[30] Foreign Application Priority Data

Mar. 22, 1976 Japan ..... 51-30943

[51] Int. Cl.[2] ..... B21D 22/14

[52] U.S. Cl. ..... 72/82; 29/159 R

[58] Field of Search ..... 72/80, 82, 83, 84, 91, 72/102; 29/159 R, 159.3; 83/564

[56] References Cited

U.S. PATENT DOCUMENTS

| | | | |
|---|---|---|---|
| 1,828,464 | 10/1931 | Harrison | 72/82 |
| 1,876,747 | 9/1932 | Raunsford | 72/82 X |
| 3,087,531 | 4/1963 | Pacek | 29/159 R |
| 3,090,265 | 5/1963 | Shumaker | 72/84 |
| 3,700,382 | 10/1972 | Pacek | 72/83 X |
| 3,852,863 | 12/1974 | Killian | 72/82 X |

*Primary Examiner*—Leon Gilden

*Attorney, Agent, or Firm*—Oblon, Fisher, Spivak, McClelland & Maier

[57] ABSTRACT

In an apparatus for forming a pair of disk-shaped metal blanks into grooved wheels, a spindle head is mounted on a support base and has rotatably supported therein a spindle for mounting a pair of mounting dies on opposite ends thereof. A pair of clamp heads are mounted on the support base at opposite sides of the spindle head and slidably and rotatably support a pair of clamping dies for clamping two blanks in cooperation with the mounting dies. A pair of brackets are rotatably suppoted on the support base and rotatably carry a pair of rollers for forming the blanks into grooved wheels. The brackets are independently rotated and the rotational movements thereof are individually restricted.

6 Claims, 6 Drawing Figures

43
III
68
67
47
64
45
65
46
55
53
50
80
81
82
83
79
78
77
56
59
58
11
41
W
28
57
63
62
25
27
III
61
60

43
45
68
67
47
54
55
53
46
51
50
49
48
12
15
16
13
14
W
IV
IV
31
28
27
25
29
30
33
32
37
38
35
34
36

APPARATUS FOR FORMING GROOVED WHEELS

BACKGROUND OF THE INVENTION

1. Field of the Invention

The present invention relates an apparatus for forming a pair of disk-shaped metal blanks into grooved wheels.

2. Description of the Prior Art

It is well known in the art, such as, in a Japanese Utility Model Registration No. 876,591 (Utility Model Publication No. 30,040/1968) that a pair of rollers arranged on diametrically opposite sides of a disk-shaped metal blank are fed toward the blank for forming a grooved wheel. In such a conventional apparatus, it has been very difficult to control the feed speeds of the two rollers to be the same so that the two rollers have not effectively functioned. Accordingly, a blank has been formed into a grooved wheel by one of the rollers in one forming operation, while another blank has been formed by the other roller in another forming operation, whereby grooved wheels with uniform accuracy have not been obtained.

It is also well known in the Japanese Utility Model Registration No. 876,591 that two blanks are mounted on opposite ends of a spindle so as to be formed simultaneously. However, in such a conventional apparatus, two rollers for forming the two blanks are synchronously connected with each other so that it has been impossible to form two different blanks at the same time. Moreover, it has been very troublesome to exchange the roller.

SUMMARY OF THE INVENTION

It is therefore an object of the present invention to provide an improved apparatus capable of forming a pair of either the same or different disk-shaped metal blanks into grooved wheels at the same time.

It is another object of the present invention to provide an improved apparatus for forming a pair of disk-shaped metal blanks into grooved wheels wherein a roller can be easily exchanged in accordance with a blank to be formed.

According to the present invention the foregoing and other objects are attained by an apparatus for forming a pair of disk-shaped metal blanks into grooved wheels which comprises a support base, a spindle head mounted on the support base, a spindle rotatably supported within the spindle head, means for rotating the spindle, a pair of mounting dies mounted on opposite ends of the spindle, a pair of clamp heads mounted on the support base at opposite sides of the spindle head, a sleeve slidably received in each of the clamp heads, a clamp shaft rotatably journalled in the sleeve in coaxial relation with the spindle, means for moving the sleeve, a clamp die mounted on one end of the clamp shaft for clamping a blank in cooperation with the mounting die, a pair of brackets rotatably supported on the support base, a roller rotatably carried on each of the brackets for forming the blank into a grooved wheel, means for independently rotating the pair of brackets, and means for individually restricting rotational movements of the brackets.

BRIEF DESCRIPTION OF THE DRAWINGS

Other objects, features and attendant advantages of the present invention will be more fully appreciated as the same becomes better understood from the following detailed description of a preferred embodiment of the invention, when considered in connection with the accompanying drawings, in which like reference numerals designate like or corresponding parts and wherein.

DETAILED DESCRIPTION OF THE PREFERRED EMBODIMENT

Figure 1:
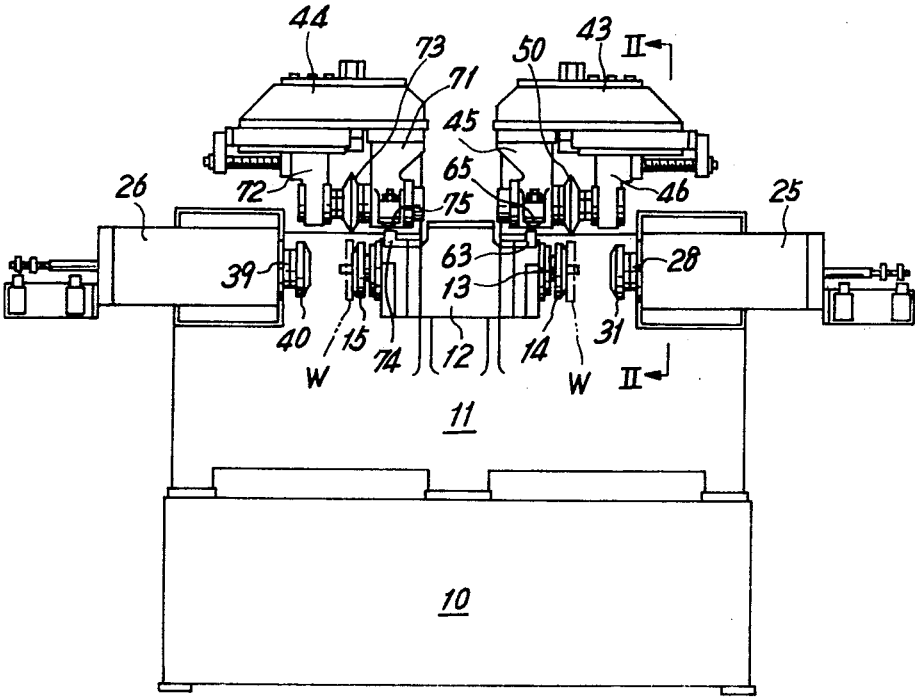
FIG. 1 is a front elevational view showing grooved wheel forming apparatus according to the present invention.
Figure 2:
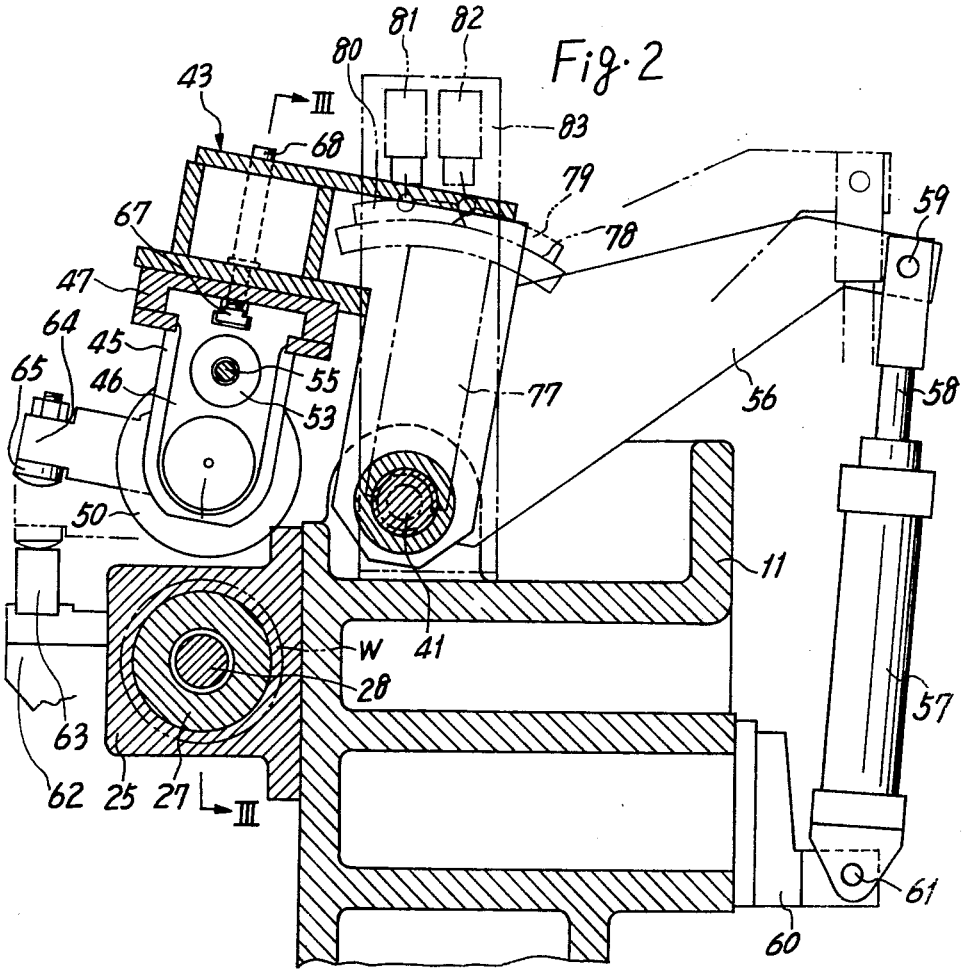
FIG. 2 is an enlarged sectional view taken along the line II—II of FIG. 1.
Figure 3:
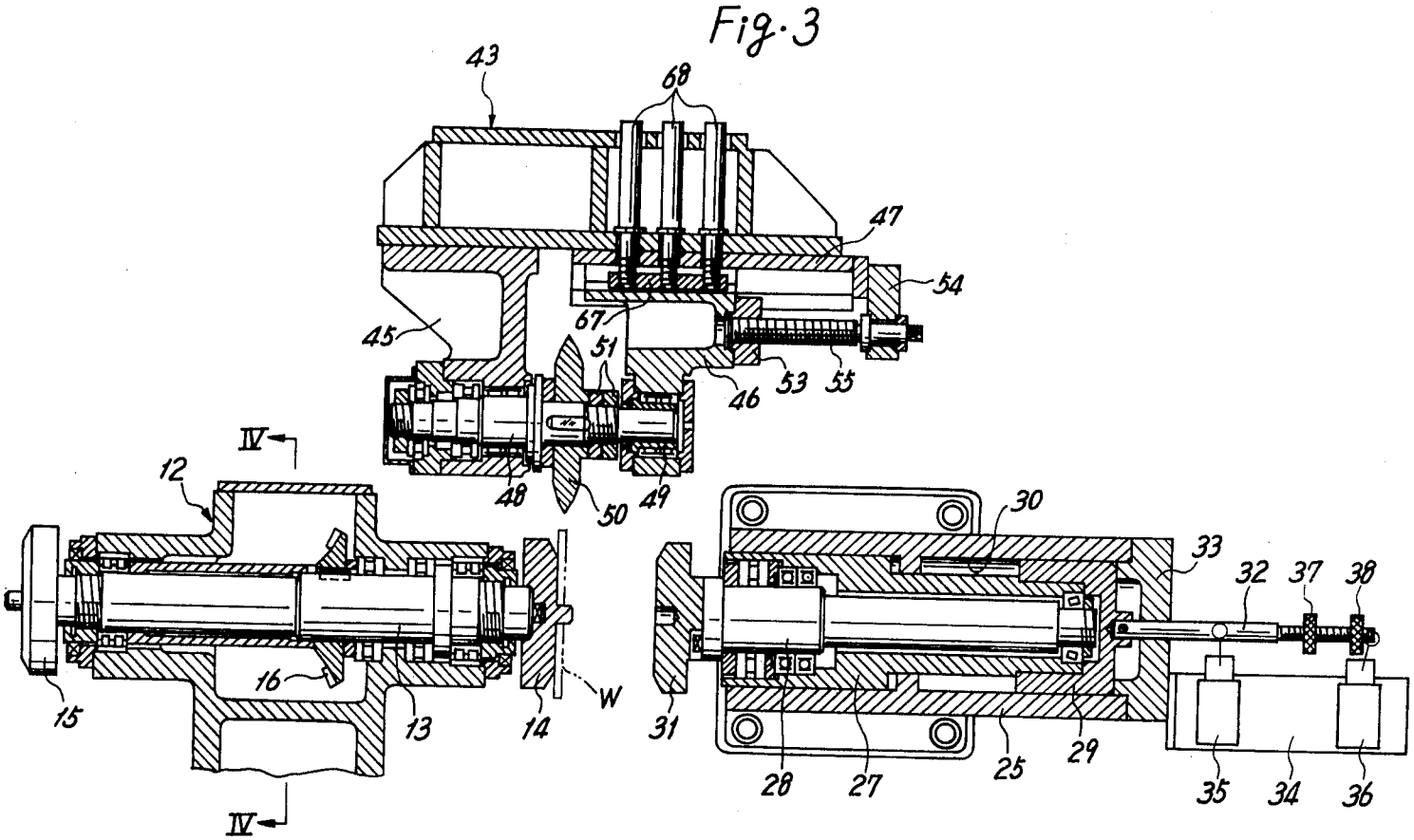
FIG. 3 is a sectional view taken along the line III—III of FIG. 2.
Figure 4:
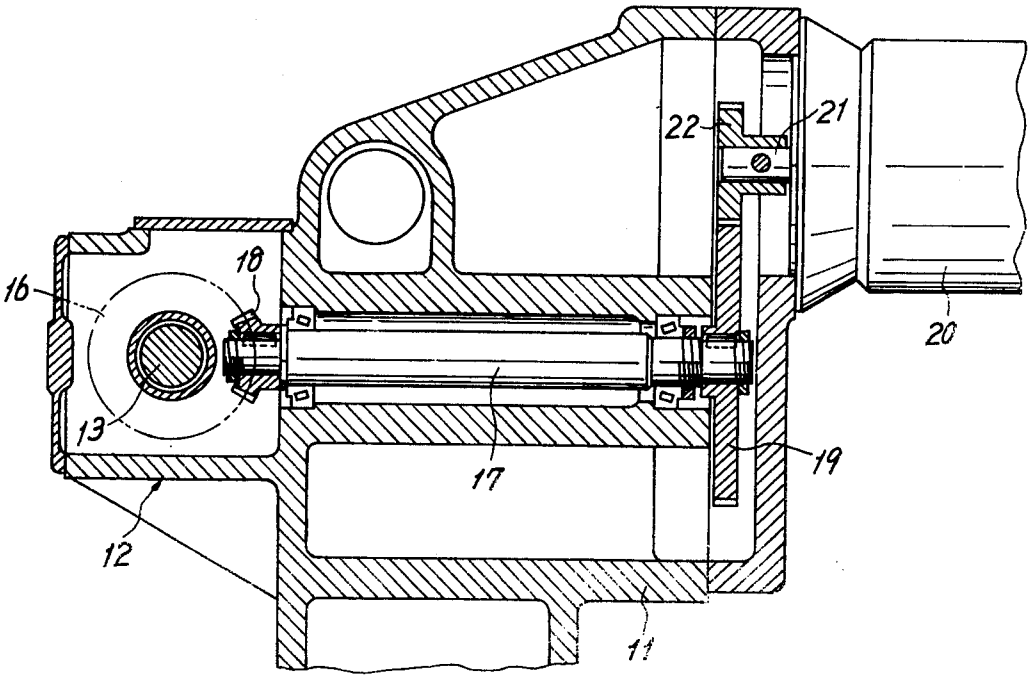
FIG. 4 is a sectional view taken along the line IV—IV of FIG. 3.

Referring now to the drawings, and more particularly to FIGS. 1, 2 and 3, there is shown a bed 10 upon which a support base 11 is fixedly mounted. At the front central portion of the support base 11 is formed a spindle head 12 into which a spindle 13 is rotatably journalled. On opposite ends of the spindle 13 are demountably mounted a pair of mounting dies 14, 15 having respective projections for mounting a pair of disk-shaped metal blanks W. A bevel gear 16 is keyed on the spindle 13 and is meshingly engaged with a bevel gear 18 keyed on one end of a shaft 17 which is rotatably journalled within the support base in a perpendicular relation with the spindle, as shown in FIG. 4. On the other end of the shaft 17 is keyed a spur gear 19 which is meshingly engaged with a spur gear 22 fixedly secured on an output shaft 21 of a drive motor 20 which is fixed to the support base 11. The bevel gears 16 and 18 and spur gears 19 and 22 operate as a speed reducer for the spindle 13.

A pair of clamp heads 25 and 26 are fixedly mounted upon the front portion of the support base 11 at opposite sides of the spindle head 12. As shown in FIG. 3, a sleeve 27 is slidably mounted within the clamp head 25 for a sliding movement in an axial direction of the spindle 13. A clamp shaft 28 is rotatably journalled within the sleeve 27 in a coaxial relation with the spindle 13. A piston 29 is secured to the rear end of the sleeve 27 and is slidably received within a cylinder 30 formed at the rear end of the clamp head 25. At the front end of the clamp shaft 28 is demountably fixed a clamp die 31 which is provided with a bore for receiving the projection of the mounting die 14. The clamp shaft 28 is bodily moved with the sleeve 27 by a sliding movement of the piston 29 so as to clamp the blank W between the clamp and mounting dies 31 and 14. A cylinder cap 33 is secured to the rear end of the cylinder 30 and mounts a support plate 34 thereon. Upon the support plate 34 are mounted two limit switches 35 and 36 which are adapted to be actuated by dogs 37 and 38 adjustably carried on a rod 32 connected to the piston 29 for confirmation of advanced and retracted ends of the sleeve 27.

As shown in FIG. 1, the other clamp head 26 is constructed similarly to the clamp head 25 and includes a clamp shaft 39 and a clamp die 40 demountably mounted on the front end of the clamp shaft 39 in an opposed relation with the other mounting die 15.

As shown in FIG. 2, a pair of support shafts 41 (one is shown) are coaxially and rotatably journalled upon the support base 11 with a predetermined distance being left therebetween in parallel relation with the spindle 13. A pair of brackets 43 and 44 are fixedly secured on the respective shafts 41 in such a manner as to be rotatable within a plain perpendicular to the axis of the spindle 13. A pair of carriers 45 and 46 are disposed on the bracket 43 and spaced from each other in an axial direction of the support shaft 41. The carrier 45 is fixedly secured to the bracket 43, while the other carrier 46 is slidably received within a guide base 47 secured to the bracket 43. A roller shaft 48 is rotatably journalled at one end thereof within the fixed carrier 45 but restrained from axial movement, and the other end of the roller shaft 48 is slidably engaged within a rotary sleeve 49 which is rotatably journalled within the movable carrier 46. On the central portion of the roller shaft 48 is keyed a roller 50 which has a predetermined shape for forming a blank into a grooved wheel. The roller 50 is clamped on the roller shaft 48 by means of a clamp nut 51. A nut 53 is fixedly secured to the movable carrier 46 and is threadedly engaged with a screw shaft 55 which is rotatably supported by a bracket 54 secured to the guide base 47.

As shown in FIG. 2, a lever 56 is integrally formed at one end thereof with the bracket 43 and connected at the other end thereof with a piston rod 58 of a cylinder 57 by means of a pin 59. The cylinder 57 is pivoted to a bracket 60 secured to the support base 11 by means of a pin 61. Movement of the piston rod 58 causes rotation of the support shaft 41 and the bracket 43 in such a manner as to bring the roller 50 into an operative engagement with a blank. In order to restrict the rotational movement of the bracket 43, a reference block 63 is exchangeably fixed to an extension 62 projected from the spindle head 12 and a stop pin 65 engageable with the block 63 is threaded into an extension 64 projected from the fixed carrier 45.

As shown in FIGS. 2 and 3, a clamp shoe 67 in T-shaped cross-section and clamp rods 68 threadedly engageable with the clamp shoe 67 are provided for clamping the movable carrier 46 on the guide base 47 at a predetermined position.

Similar to the bracket 43, the other bracket 44 is provided with a fixed carrier 71 and a movable carrier 72. A roller 73 is mounted on a roller shaft, not shown, which is journalled between the carriers 71 and 72. The bracket 44 is rotatable by a cylinder, not shown, and the rotational movement of the bracket 44 is restricted by engagement of a stop pin 75 threaded into the fixed carrier 71 with a reference block 74 exchangably fixed on the spindle head 12.

The support shafts 41 fixedly mounting the respective brackets 43 and 44 have fixed thereon support plates 77. Each support plate 77 has formed thereon a pair of arcuate mounting surfaces 78 which are spaced in an axial direction. A pair of arcuate dogs 79 and 80 are adjustably mounted on the respective mounting surfaces 78. A pair of limit switches 81 and 82 associated with the dogs 79 and 80, respectively, are mounted on a plate 83 fixed on the support base 11.

The apparatus as described above is capable of simultaneously forming two blanks W, W mounted on the mounting dies 14 and 15 fixed on the opposite ends of the spindle 13. The two blanks W, W may be either identical or different. For this purpose, the brackets 43 and 44 are operated independently by the respective cylinders 57 and the rotational movements of the brackets 43 and 44 are restricted individually by the reference blocks 63 and 74. The mounting dies 14 and 15, the clamp dies 31 and 40, the rollers 50 and 73 and reference blocks 63 and 74 are selected depending upon the blanks to be formed. Moreover, consideration is taken for an easy exchange of the rollers 50 and 73 by a simple operation, as hereinafter described.

The operation of the apparatus according to the present invention will now be described.

Figure 5:
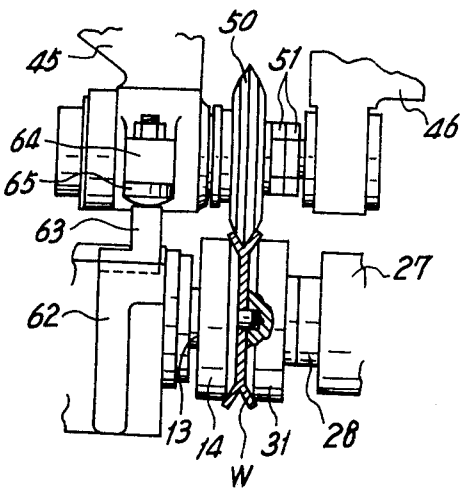
FIG. 5 is a view showing a roller tool in operative engagement with an edge portion of a blank to be formed.

The blanks W, W are mounted on the mounting dies 14 and 15 fixed on the opposite ends of the spindle 13 by an operator. Then, a push button, not shown, is pressed to start an automatic cycle. From now on, a description of the automatic cycle is substantially given for the blank mounted on the mounting die 14. With the push button being pressed, pressurized fluid is supplied into the rear chamber of the cylinder 30 to thereby advance the piston 29 and the sleeve 27 toward the blank to clamp the blank between the mounting die 14 and the clamp die 31. At the advanced end of the clamp die 31, the dog 37 moved with the piston 29 actuates the limit switch 35. With the limit switch 35 and a corresponding limit switch for the clamp die 41 being actuated, the motor 20 is energized to rotate the spindle 13, and simultaneously pressurized fluid is supplied into the lower chamber of the cylinder 57. When the spindle 13 is rotated, the mounting die 14, the blank W, the clamp die 31 and the clamp shaft 28 are rotated as a unit. When pressurized fluid is supplied into the cylinder 57, the shaft 41 and the bracket 43 are rotated in a counterclockwise direction, as viewed in FIG. 2, so that the roller 50 is brought into operative engagement with the peripheral portion of the blank W. Further movement of the roller 50 toward the blank causes the peripheral portion of the blank to be split and spread into a V-shaped annular groove, as shown in FIG. 5.

When the roller 50 is moved into the blank a predetermined distance, the limit switch 81 is actuated by the dog 79 so as to increase the pressure of the fluid supplied into the cylinder 57. Subsequently, the stop pin 65 is moved into abutting engagement with the reference block 63 to stop the rotational movement of the bracket 43. When the pressure of the fluid is increased, the press power of the roller 50 against the blank is increased for a final forming operation. The final forming operation is continued for a predetermined time period preset by a timer, not shown, which is energized by actuation of the limit switch 81.

When the timer is timed out, pressurized fluid is supplied into the upper chamber of the cylinder 50 so as to rotate the bracket 43 in a clockwise direction, as viewed in FIG. 2, to thereby retract the roller 50 from the finished blank W. With the bracket 43 being rotated a predetermined angle, the limit switch 82 is actuated by the dog 80. When the limit switch 82 and a corresponding limit switch for the bracket 44 are actuated, supply of pressurized fluid to the cylinder 57 is stopped and the motor 20 for the spindle 13 is deenergized. When rotation of the spindle 13 is stopped, pressurized fluid is supplied into the front chamber of the cylinder 30 to move the clamp die 31 away from the finished blank. Subsequently, the dog 38 actuates the limit switch 36. When the limit switch 36 and a corresponding limit switch for the clamp die 14 are actuated, the automatic cycle is completed. Accordingly, the two blanks are formed into grooved wheels which are removed from the mounting dies 14 and 15 by the operator.

The two blanks are individually operated by the respective rollers 50 and 73, whereby forming accuracy of the finished blanks is maintained uniform. Furthermore, the brackets 43 and 44 mounting the respective rollers 50 and 73 are independently operated so that different blanks may be operated at the opposite ends of the spindle 13. Exchange of rollers 50 and 73 in accordance with variation of the blank in size is easily performed, as hereinafter described.

Figure 6:
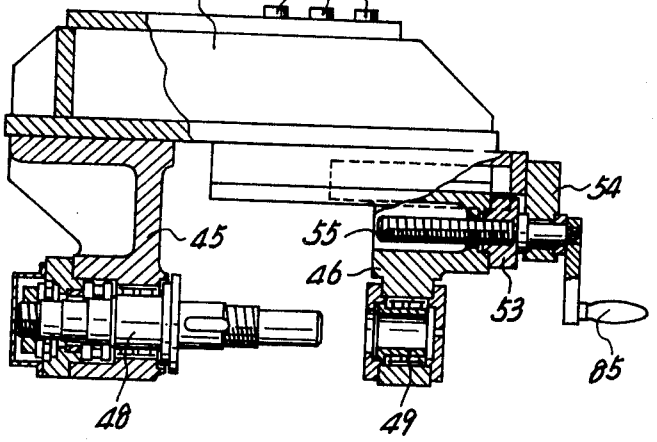
FIG. 6 is a view showing different positions of the component parts shown in FIG. 3 for an exchange of a roller tool.

The clamp rods 68 are rotated relative to the clamp shoe 67 so that the movable carrier 46 is unclamped from the guide base 47. A hand wheel 85 is mounted on one end of the screw shaft 55 to rotate the same in such a manner that the movable carrier 46 is moved along the guide base 47 in a direction away from the fixed carrier 45. One end of the roller shaft 48 is subsequently disengaged and separated from the rotary sleeve 49 rotatably journalled within the movable carrier 46, as shown in FIG. 6, whereby a space sufficient to remove the roller 50 from the roller shaft 48 is provided between one end of the roller shaft 48 and the movable carrier 46. The clamp nut 51 is then disengaged from the roller shaft 48 so as to permit the roller 50 to be removed from the roller shaft 48. A new roller is subsequently mounted on the roller shaft 48 in a reverse manner as mentioned above.

Obviously, numerous modifications and variations of the present invention are possible in light of the above teachings. It is therefore to be understood that within the scope of the teachings herein and the appended claims the invention may be practiced otherwise than as specifically described herein.

What is claimed as new and desired to be secured by Letters Patent of the United States is:

1. An apparatus for forming a pair of disk-shaped metal blanks into grooved wheels comprising:

a support base;

a spindle head mounted on said support base;

a spindle rotatably supported within said spindle head;

means for rotating said spindle;

a pair of mounting dies mounted on opposite ends of said spindle;

a pair of clamp heads mounted on said support base at opposite sides of said spindle head;

a sleeve slidably received in each of said clamp heads;

a clamp shaft rotatably journalled in said sleeve in coaxial relation with said spindle;

means for moving said sleeve in an axial direction;

a clamp die mounted on one end of said clamp shaft for clamping a blank in cooperation with said mounting die;

a pair of brackets rotatably supported on said support base;

a pair of carriers supported on each of said brackets and spaced from each other in an axial direction of said spindle;

a roller shaft rotatably journalled between said pair of carriers;

a roller carried on said roller shaft for forming the blank into a grooved wheel;

one of said pair of carriers being fixedly supported on said bracket and the other carrier being slidably supported in said bracket for a sliding movement in an axial direction of said roller shaft, whereby one end of said roller shaft is disengaged from said slidable carrier by a sliding movement thereof;

means for independently rotating said pair of brackets; and means for individually restricting rotational movements of said brackets.

2. An apparatus as claimed in claim 1, wherein said roller shaft is rotatably journalled at one end thereof within said fixed carrier but restrained from axial movement relative thereto, and the other end of said roller shaft is slidably engaged within said slidable carrier.

3. An apparatus as claimed in claim 2 further comprising:

a nut fixedly secured to said slidable carrier; and a screw shaft threadedly engaged at one end thereof with said nut and rotatably supported at the other end thereof by said bracket.

4. An apparatus as claimed in claim 3 further comprising:

means for clamping said slidable carrier on said bracket at a predetermined position.

5. An apparatus for forming a pair of disk-shaped metal blanks into grooved wheels comprising:

a support base;

a spindle head mounted on said support base;

a spindle rotatably supported within said spindle head;

means for rotating said spindle;

a pair of mounting dies mounted on opposite ends of said spindle;

a pair of clamp heads mounted on said support base at opposite sides of said spindle head;

a sleeve slidably received in each of said clamp heads;

a clamp shaft rotatably journalled in said sleeve in coaxial relation with said spindle;

means for moving said sleeve in an axial direction;

a clamp die mounted on one end of said clamp shaft for clamping a blank in cooperation with said mounting die;

a pair of brackets rotatably supported on said support base;

a roller rotatably carried on each of said brackets for forming the blank into a grooved wheel;

means for independently rotating said pair of brackets and comprising a pair of hydraulically actuated cylinders which are independently actuated, the pressure of fluid supplied into each of said hydraulic cylinders being increased at a predetermined rotational movement of said brackets.

6. An apparatus as claimed in claim 5 further comprising:

dog means mounted on each of said brackets to be moved therewith; and switch means mounted on said support base to be actuated by said dog means at said predetermined rotational movement of each of said brackets so as to increase the pressure of fluid supplied into each of said hydraulic cylinders.

* * * * *